US007700006B2

(12) United States Patent
Blumberg et al.

(10) Patent No.: US 7,700,006 B2
(45) Date of Patent: Apr. 20, 2010

(54) VOLTAGE REGULATORS

(75) Inventors: Girsh Blumberg, New Providence, NJ (US); Peter B. Littlewood, Cambridge (GB)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 2289 days.

(21) Appl. No.: 10/159,449

(22) Filed: May 31, 2002

(65) Prior Publication Data

US 2003/0221859 A1 Dec. 4, 2003

(51) Int. Cl.
*H01B 1/00* (2006.01)
*H01B 1/02* (2006.01)
*G05F 5/00* (2006.01)

(52) U.S. Cl. ..... 252/500; 323/299; 252/518.1

(58) Field of Classification Search ..... 252/500, 252/518.1; 323/299
See application file for complete search history.

(56) References Cited

U.S. PATENT DOCUMENTS 4,580,110 A 4/1986 Bhattacharya et al. .... 332/16 R
4,636,737 A 1/1987 Bhattacharya et al. ..... 329/110
5,572,052 A 11/1996 Kashihara et al. ..... 257/295
5,906,963 A 5/1999 Simon et al. ..... 505/190
6,083,765 A 7/2000 Tempel ..... 438/3
6,144,546 A 11/2000 Mizushima et al. ..... 361/303
6,297,200 B1 10/2001 Simon et al. ..... 505/238

OTHER PUBLICATIONS

Colorado Superconductor webpage (http://www.users.qwest.net/~csconductor/Experiment_Guide/Four%20Point%/20Probe.htm).*
Siegrist, T. et al., *A New Layered Cuprate Structure-Type,* $(A_{1-x}A^1_x)_{14}Cu_{24}O_{41}$, Mat. Res. Bull., 1988, vol. 23, pp. 1429-1438.
McCarron, E.M. III et al., *The Incommensurate Structure of* $(Sr_{14-x}Ca_x)Cu_{24}O_{41}$ (0 <x ~8), *A Superconductor Byproduct*, Mat. Res. Bull., 1988, vol. 23, pp. 1355-1365.
Kimura, S. Shindo, I., *Single Crystal Growth of Yig by the Floating Zone Method*, Journal of Crystal Growth 41 (1977) pp. 192-198.
Strobel, P. et al., *Crystal Growth and Characterization of the Superconducting Phase in the Bi-Sr-Cu-O System*, Physica C 156 (1988) pp. 434-440.
Kitano, H. et al., *Microwave and millimeter wave spectroscopy in the slightly hole-doped ladders of* $Sr_{14}Cu_{24}O_{41}$, Preprint, Aug. 14, 2001, arXiv:cond-mat/0108222, 7 pages.
Motoyama, N., Osafune, T., Kakeshita, T., Eisaki, H., Uchida, S., *Effect of Ca substitution and pressure on the transport and magnetic properties of* $Sr_{14}Cu_{24}O_{41}$ *with doped two-leg Cu-O ladders*, Physical Review B, Feb. 1, 1997, vol. 55, No. 6, pp. R3386-R3389.

(Continued)

*Primary Examiner*—Mark Kopec
*Assistant Examiner*—Jaison P Thomas
(74) *Attorney, Agent, or Firm*—John F. McCabe

(57) ABSTRACT

An apparatus includes an object formed of a quasi-1D crystalline material that is capable of supporting a free sliding density wave state. The apparatus also includes first and second input terminals that connect across a portion of the object and first and second output terminals that connect across the same portion of the object.

18 Claims, 5 Drawing Sheets

OTHER PUBLICATIONS

Tanaka, I., Kojima, H., *Superconducting single crystals*, Jan. 5, 1989, Nature vol. 337 pp. 21, 22.

Ramirez, A.P., Subramanian, M.A., Gardel, M., Blumberg, G., Li, D., Vogt, T., Shapiro, S.M., *Giant dielectric constant response in a copper-titanate*, Solid State Communications 115 (2000) pp. 217-220.

Osafune, T., Motoyama, N., Eisaki, H., Uchida, S., *Optical Study of the $Sr_{14-x}Ca_xCu_{24}O_{41}$ System: Evidence for Hole-Doped $Cu_2O_3$ Ladders*, Mar. 10, 1997, Physical Review Letters, vol. 78, No. 10., pp. 1980-1983.

McElfresh, M.W., Coey, J.M.D., Strobel,P., von Molnar, S., *Electronic properties of $Sr_{14}Cu_{24}O_{41}$*, Physical Review B, Jul. 1, 1989, vol. 40, No. 1., pp. 825-828.

Gozar, A. et al., *Spin dynamics of $Sr_{14}Cu_{24}O_{41}$ two-ladder studied by Raman spectroscopy*, Preprint, arXiv:cond-mat/0108507 v2 Sep. 4, 2001, 4 pages.

Littlewood, P.B., *Bistability Of Non-Linear Conductivity in Insulators With Sliding Charge Density Waves*, Solid State Communications, vol. 65, No. 11, 1988, p. 1347-1350.

Gruner, George: *Density Waves in Solids*, (Addison-Wesley Publishing Company, 1994), Ch. 2, pp. 15-30; Ch. 8, pp. 150-163; Ch. 9, pp. 164-181; Ch. 10, pp. 182-197.

Littlewood, P.B., "*Screened dielectric response of sliding charge-density waves*," The American Physical Society, Physical Review B, vol. 36, No. 6, Aug. 15, 1987-II, pp. 3108-3116.

Yutaka Furubayashi, Takahito Terashima, Iksu Chong, and Mikio Takano, *Epitaxial growth of single-crystalline thin film of $Ca_{14}Cu_{24}O_{41}$: A heavily hole-doped two-legged spin ladder*, Physical Review B, Aug. 1, 1999, vol. 60, No. 6, pp. R3720-R3723.

Vuletic, T., et al., "Suppression of the Charge-Density-Wave State in $Sr_{14}Cu_{24}O_{41}$ by Calcium Doping," Physical Review Letters, vol. 90, No. 25, pp. 257002-1 to 257002-4, Jun. 27, 2003.

Gozar, A., et al., "Collective Density-Wave Excitations in Two-Leg $_{Sr14-x}CA_xCu_{24}O_{41}$ Ladders," Physical Review Letters, vol. 91, No. 8, pp. 087401 to 1-087401-4, Aug. 22, 2003.

Blumberg, G, Littlewood, P., Gozar, A., Dennis, B.S., Motoyama, N., Eisaki, H., Uchida, S., *Sliding Density Wave in $Sr_{14}Cu_{24}O_{41}$ Ladder Compounds*, Science, Jul. 26, 2002, vol. 297, pp. 684-687.

Sugii, et al., "Growth of $Sr_{1-x}Nd_xCuO_y$ thin films by RF-magnetron sputtering and their crystallographic properties," Physica C 196, (1992), pp. 129-134.

Dorger, M., et al., "Room temperature charge transfer in two-leg cuprate ladder compounds," Physica C 341-348 (2000), pp. 477-478.

Lagues, M., et al., "Transport properties of MBE grown Cuprate Spin Ladders," Physica C 282-287 (1997), pp. 162-165.

Koster, G., et al., Abstract for "Superconductivity and Its Applications," Physica C353 (3-4): 167-183, May 15, 2001, published on ISI Web of Science (2001), 1 page.

Kojima, K.M., et al., Abstract for "The electronic properties of cuprate ladder materials," Journal of Electron Spectroscopy and Related Phenomena, 117: 237-250, Jun. 2001, published on ISI Web of Science (2001), 1 page.

* cited by examiner

VOLTAGE REGULATORS

BACKGROUND

1. Field of the Invention

This invention relates generally to circuits using non-linear electronic devices and, more particularly, to electronic voltage regulators.

2. Discussion of the Related Art

One conventional electronic circuit for regulating output voltages is a clipper. The clipper is a 4-terminal circuit that includes a diode and a resistor. The clipper comes in both a series configuration and a parallel configuration. In the series configuration, the diode is in series with an output load, and the resistor is in parallel with the output load. In the parallel configuration, the diode is in parallel with the output load and the resistor is in series with the output load. In both configurations, the clipper clips off input voltages located to one side of a fixed voltage threshold. The clipper also produces output voltages approximately equal to input voltage if the input voltage is located on the other side of the voltage threshold.

By clipping off voltages that are located to one side of the fixed voltage threshold, clippers function as simple voltage regulators. While many circuit designs for voltage regulators are known, new designs for voltage regulators are always desirable if the new designs offer improved operation and/or greater flexibility.

SUMMARY

Various embodiments provide circuits that regulate voltages by using non-linear properties of quasi one-dimensional (1D) crystals with density wave states. The quasi-1D crystals make transitions from relatively non-conducting states, i.e., insulating states, to relatively conducting states in response to applications of above threshold voltages. The embodiments use the insulating-conducting transitions to produce voltage regulation.

In one aspect, the invention features an apparatus for producing regulated output voltages. The apparatus includes an object formed of a quasi-1D crystalline material that supports a free sliding density wave state. The apparatus also includes first and second input terminals that connect across a portion of the object and first and second output terminals that connect across, at least, the same portion of the object.

In some embodiments, the input terminals enable selectively applying an input voltage across one of a plurality of portions of the crystal. The voltage produced at the output terminals depends on the selected portion of the crystal across which the voltage is applied.

DETAILED DESCRIPTION OF VARIOUS EMBODIMENTS

Many experimental investigations have studied properties of cuprate ladder materials. Earlier investigations studied low temperature properties of cuprate ladder materials, because these materials behave as superconductors at low temperatures. More recent investigations have studied properties of cuprate ladder materials at higher temperatures, e.g., room temperature. For example, U.S. patent application Ser. No. 10/043372 ('372), filed Jan. 9, 2002, which is incorporated herein by reference, describes dielectric properties of doped cuprate ladder crystals. The investigation described in the '372 application reveals that some doped cuprate ladder crystals have density wave states at room temperature and above.

The presence of a density wave state affects the electrical response of a material. Weak applied electric fields typically do not free the density wave from pinning by material defects, and the density wave only oscillates about an equilibrium pinned position in response to weak applied fields. Strong applied electric fields can depin the density wave thereby causing a translational motion of the density wave that significantly changes the DC electrical response of the material. Embodiments described herein exploit changes to conduction properties that are produced by depinning of a charge and/or spin density wave in a quasi-1D material with a density wave state.

Figure 1:
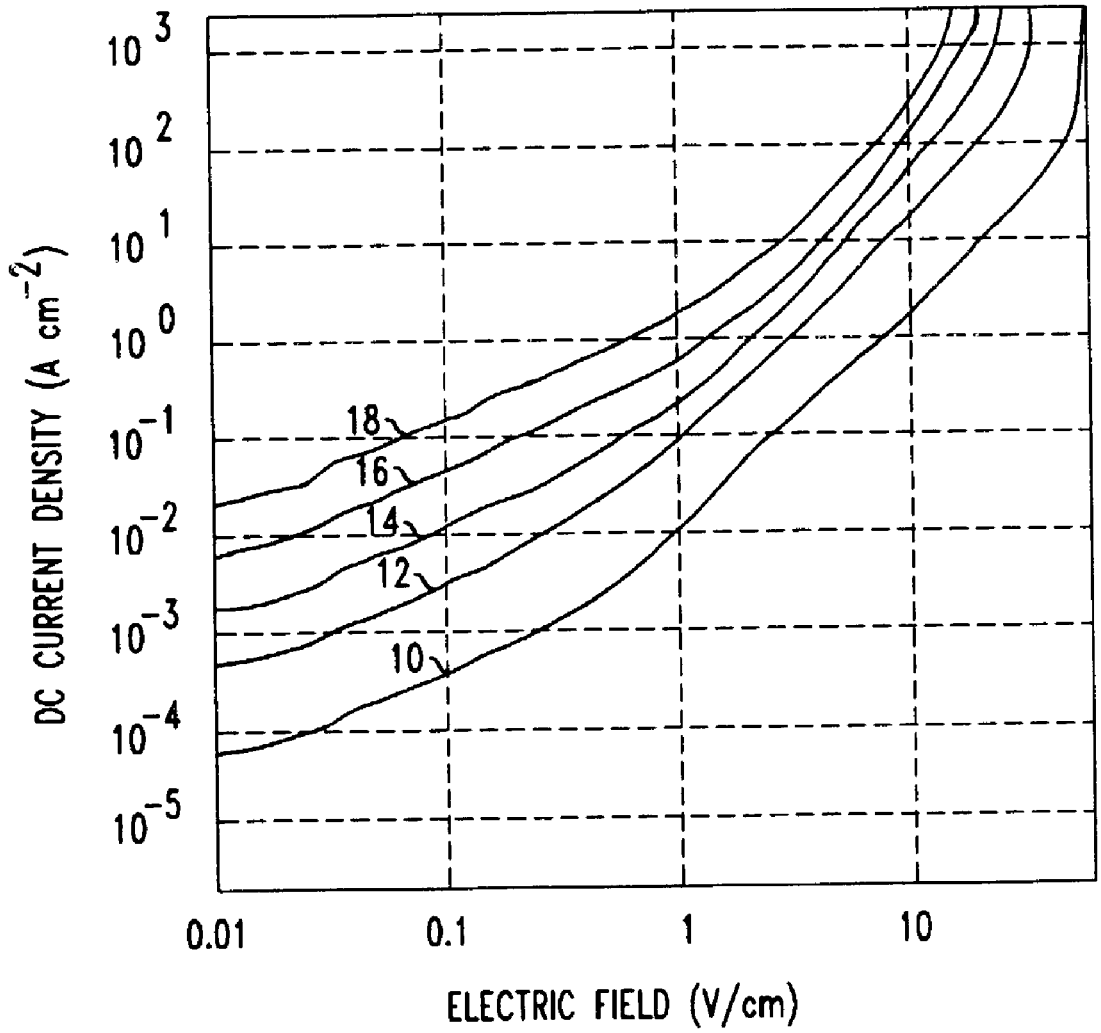
FIG. 1 provides log-log plots that show how the DC current density in a $Sr_{14}Cu_{24}O_{41}$ crystal depends on the strength of an applied electric field.

FIG. 1 shows measured DC current characteristics 10, 12, 14, 16, and 18 of crystalline $Sr_{14}Cu_{24}O_{41}$, i.e., a doped cuprate ladder material. The DC current characteristics 10, 12, 14, 16, and 18 correspond to respective sample temperatures of 100 Kelvin (K), 120 K, 140 K, 160 K, and 180 K and describe conduction properties along the standard "c" crystalline axis of $Sr_{14}Cu_{24}O_{41}$ sample. The "c" crystalline axis is also the special direction along which $Sr_{14}Cu_{24}O_{41}$ supports a quai-1D density wave state. See e.g., the '372 application.

The characteristics 10, 12, 14, 16, 18 show how currents in a $Sr_{14}Cu_{24}O_{41}$ crystal respond to an electric field of constantly increasing strength. After sweeping the applied electric field to the highest values shown in FIG. 1, the DC current will trace out a somewhat different characteristic as the strength of the electric field is subsequently reduced. These hysteresis effects are not seen in the characteristics 10, 12, 14, 16, 18 of FIG. 1.

From the DC current characteristics 10, 12, 14, 16, 18, one sees that a $Sr_{14}Cu_{24}O_{41}$ crystal has distinctly different conductivity behaviors for different applied electric field strengths. For electric fields weaker than about 0.1-0.2 volts per centimeter (V/cm), the crystal's current response to small variations in the electric field is linear in the field variation so that the material has an ohmic behavior. For electric fields between about 0.1-0.2 V/cm and about 10-20 V/cm, the crystal's current response to small variations in the field is approximately quadratic in the field variation so that the material has a non-ohmic behavior. For electric fields stronger than about 10-20 V/cm, the crystal's current response to small variations in the field is much stronger than quadratic in the field variation.

For electric fields stronger than 20-25 V/cm, local slopes of current-electric field characteristics 10, 12, 14, 16, 18 are several times larger than the local slopes of the same characteristics 10, 12, 14, 16, 18 for electric fields weaker than about 10 V/cm. In a quasi-1D material with a density wave state, a relative increase in a current-electric field characteristic's local slope by a factor of about 10-30 when the magnitude of the corresponding electric field value increases by a factor of about 2 to about 10 indicates the presence of a free sliding density wave state. In the free sliding state, the density wave slides between adjacent pinning centers in a time that is too short for the rearrangements of quasi-particle excitations needed to screen the wave's sliding. Herein, electronic apparatus exploit the strong current response produced by a free sliding state of a density wave.

Figure 2:
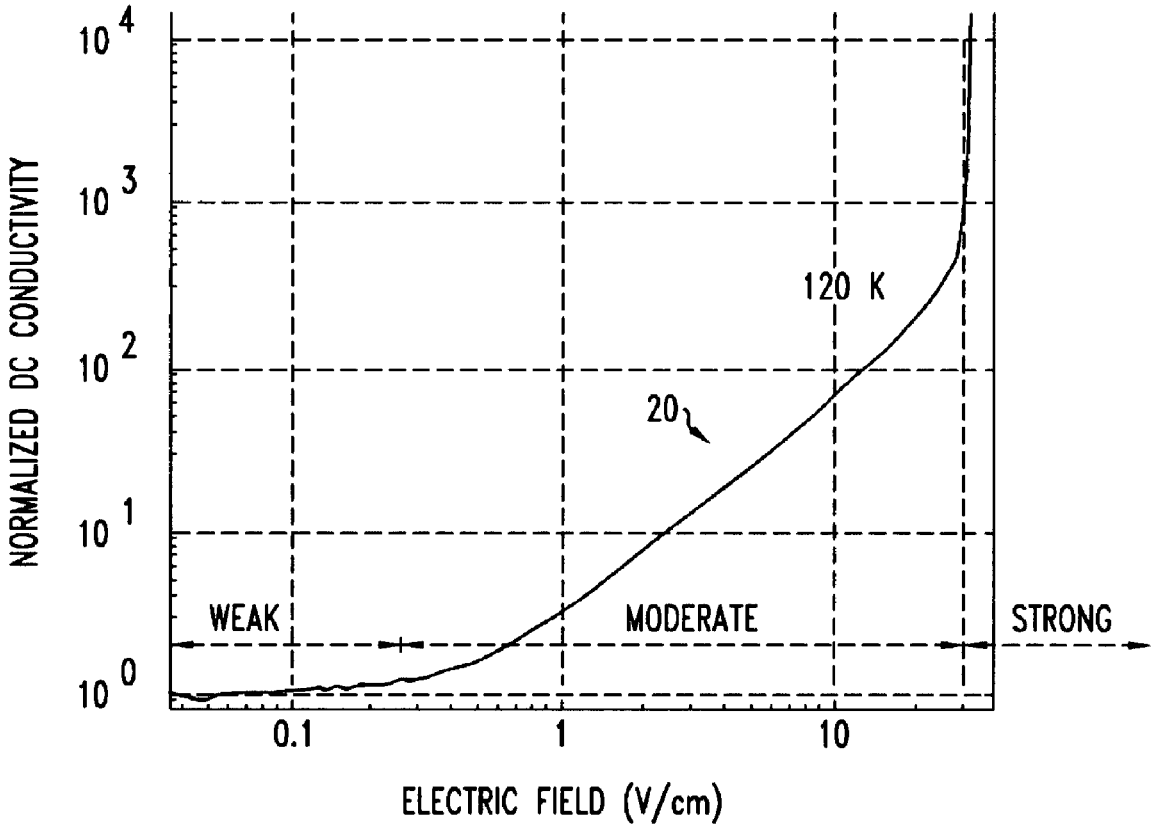
FIG. 2 is a log-log plot of the conductivity of the same $Sr_{14}Cu_{24}O_{41}$ crystal as a function of the strength of the applied electric field.

FIG. 2 provides a plot 20 of the normalized DC conductivity of $Sr_{14}Cu_{24}O_{41}$ at 120 K. The plot 20 shows that the conductivity is constant and thus, ohmic for electric fields weaker than about 0.1-0.2 V/cm, i.e., weak fields. The plot 20 also shows that the conductivity varies approximately linearly with small field variations for field values between about 0.2 V/cm and about 20 V/cm, i.e., moderately strong fields. Finally, the plot 20 shows that the conductivity varies much more rapidly than linearly with small variations in the field for field values greater than about 20-30 V/cm, i.e., strong fields. For such strong fields, the conductivity of $Sr_{14}Cu_{24}O_{41}$ is so high that total measured resistances are mainly due to connecting leads and contacts.

Figure 3:
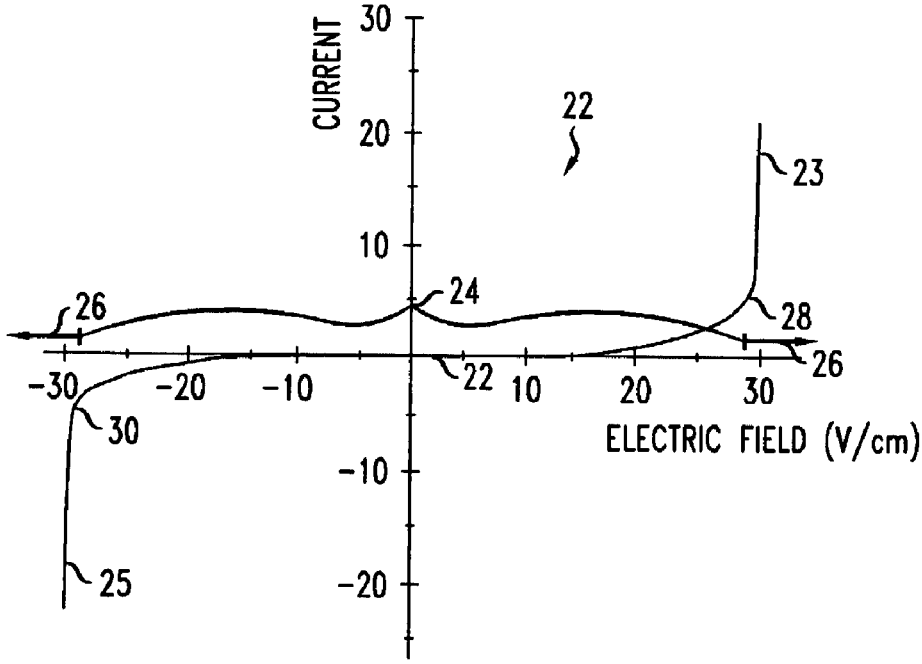
FIG. 3 is a standard plot of the current-electric field characteristic for the same crystal described by FIGS. 1-2.

Plotting a current characteristic of $Sr_{14}Cu_{24}O_{41}$ on a standard non-logarithmic scale aids in comparing this crystal's behavior to that of other known structures. FIG. 3 shows a standard plot 22 of the current characteristic of $Sr_{14}Cu_{24}O_{41}$ at 120 K. The standard plot 22 shows that the crystal behaves like a fair insulator for weak or moderately strong electric fields, because the crystal only carries small currents for such fields (region 24). The standard plot 22 also shows that the crystal behaves like a conductor for strong electric fields, because the crystal carries much larger currents for such fields than for weak or moderately strong applied fields (regions 26). The plot 22 also shows that well-defined elbow regions 28, 30 abruptly separate field regions where the crystal changes from a fair insulator, i.e., for weak and moderately strong fields, to a reasonably good conductor, i.e., for strong fields.

Figure 4:
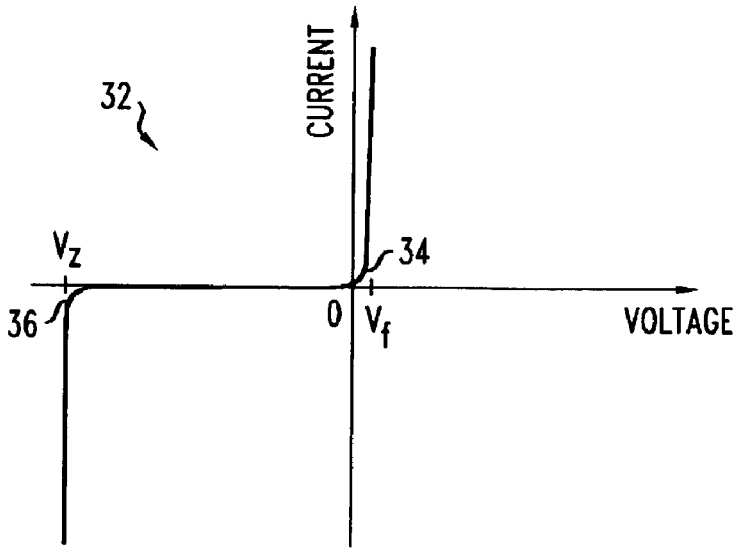
FIG. 4 (PRIOR ART)
FIG. 4 is a standard plot of the current-voltage characteristic for a conventional semiconductor junction diode.

FIG. 4 shows a current characteristic 32 of a conventional semiconductor junction diode (not shown). The current characteristic 32 also has well-defined elbow regions 34, 36 where the diode's behavior changes from that of an insulator to that of a reasonably good conductor. The transitions to conductive states at elbow regions 34 and 36 are behaviors responsive to forward and reverse biasing voltages $V_f$ and $V_z$. The values of $V_f$ and $V_z$ are related to properties of the semiconductor junction.

A qualitative comparison of plots 22 and 32 of FIGS. 3 and 4 shows that a $Sr_{14}Cu_{24}O_{41}$ crystal and a zener diode have similar current-voltage characteristics. Due to the similarity of the current-voltage characteristics, a rod of crystalline $Sr_{14}Cu_{24}O_{41}$ can replace a semiconductor junction diode, i.e., a zener diode, in a variety of conventional circuit designs. Such a replacement would also include adjusting circuit parameters to compensate for differences in ON/OFF switching voltage values at the elbow regions 26, 28 and elbow regions 34, 36 of the $Sr_{14}Cu_{24}O_{41}$ crystal and semiconductor junction diode, respectively. Determining how to adjust circuit parameters to compensate for differences in ON/OFF switching voltages in such a replacement would be circuit-dependent and not require undue experimentation by those of skill in the electronics art.

One additional difference between the current responses of a rod of crystalline $Sr_{14}Cu_{24}O_{41}$ and a semiconductor junction diode is important. The current behavior of a rod of crystalline $Sr_{14}Cu_{24}O_{41}$ is a bulk conduction property rather than a junction property as in the semiconductor diode. Due to the bulk nature of $Sr_{14}Cu_{24}O_{41}$'s current characteristic, bodies made from crystalline $Sr_{14}Cu_{24}O_{41}$ will have values of ON/OFF switching voltages that depend on the physical dimensions of the bodies. For a rod-like body of $Sr_{14}Cu_{24}O_{41}$ with contacts at opposite sides of the rod, the ON/OFF switching voltage will depend approximately linearly on the rod's length, i.e., if the crystalline "c" axis is along the rod's axis. This dependence of the ON/OFF switching voltage on physical dimensions of the body makes crystalline $Sr_{14}Cu_{24}O_{41}$ a significantly more flexible material for constructing electronic devices than semiconductor junctions. In particular, crystalline $Sr_{14}Cu_{24}O_{41}$ enables constructing devices with selected ON/OFF switching voltages rather inherently fixed voltages as in junction diodes. In semiconductor junction diodes, the ON/OFF switching voltage is fixed by the unchangeable bandgap of the semiconductor material.

Figure 5A:
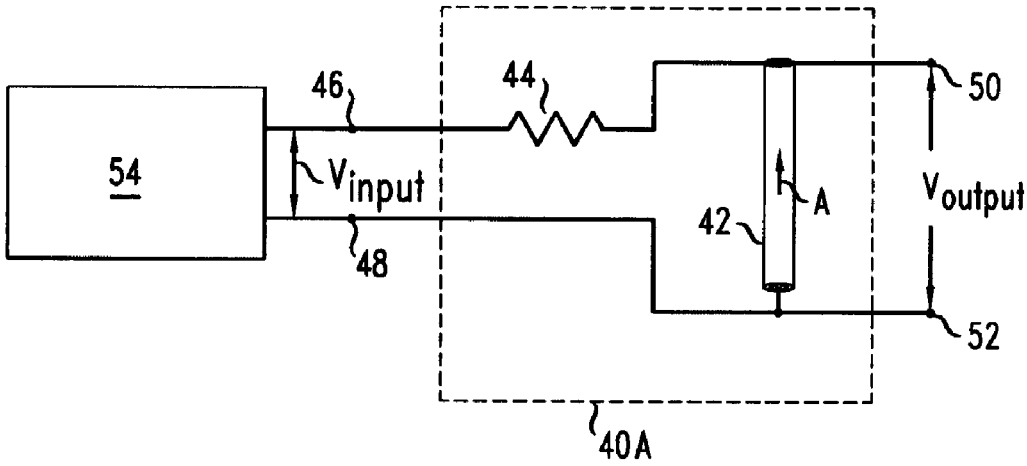
FIG. 5A shows a voltage regulator based on a quasi-1D crystal that supports a free sliding density wave state.
Figure 5B:
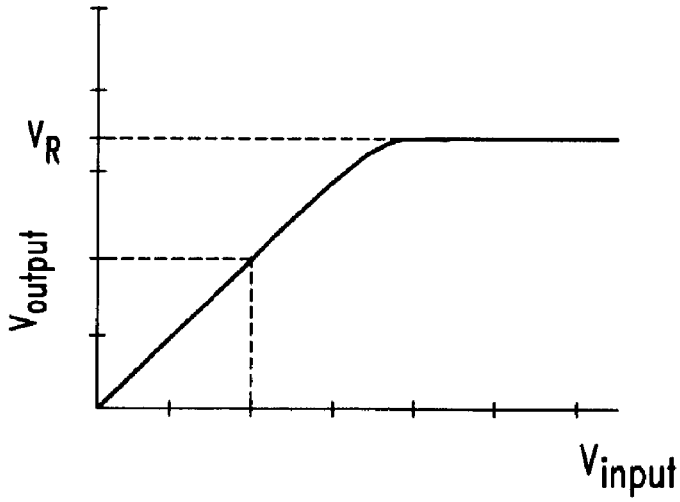
FIG. 5B shows the input-output voltage characteristic of the voltage regulator of FIG. 5A.
Figure 5C:
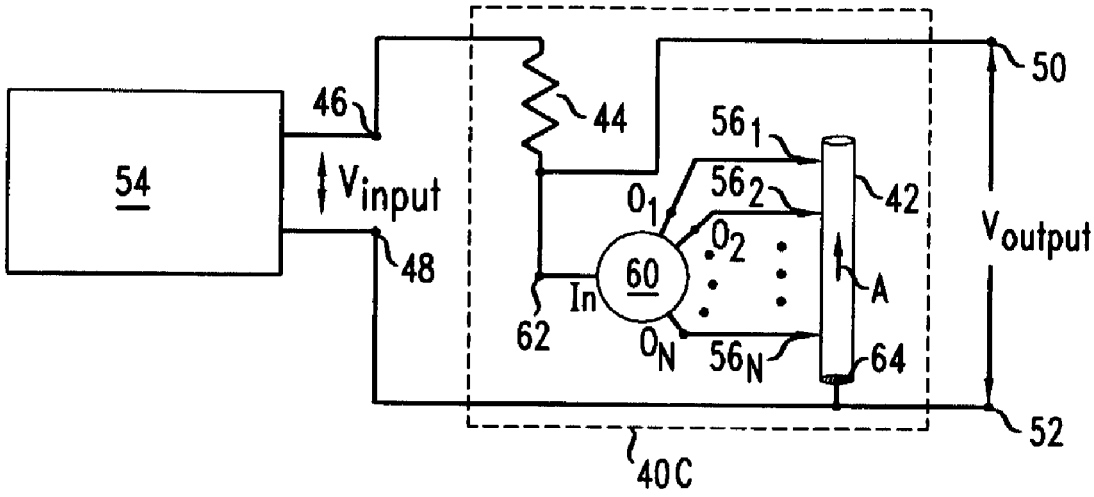
FIG. 5C shows a variable voltage regulator that is based on a quasi-1D crystal that supports a free sliding density wave state.

FIGS. 5A and 5C show electronic circuits in which a quasi-1D crystalline material with a free sliding density wave state (FSDWS) replaces the function of a conventional diode. Exemplary FSDWS materials include doped cuprate ladder crystals such as $Sr_{14}Cu_{24}O_{41}$ and $Sr_{14-x}Ca_xCu_{24}O_{41}$ with $0<x<12$. Two processes for making such doped cuprate ladder crystals are described in the above-referenced '372 patent application. The first process is that of the article of E. M. McCarron, III et al in Mat. Res. Bull. Vol. 23 (1988) pages 1355-1365. The second process is that of the article of Motoyama et al in Physical Review 55B (1997) pages R3386-R3389. The second process is based on a traveling-solvent-floating-zone method, which is described in the articles of Tanaka et al, i.e., Nature 337 (1989) pages 21-22, and of Kimura et al, i.e., Journal of Crystal Growth 41 (1977) pages 192-198. The McCarron, Motoya, Tanaka, and Kimura articles are incorporated herein by reference in their entirety.

FIG. 5A shows a voltage regulator 40A that uses an electronic device made of a quasi-1D crystalline material with a FSDWS. The voltage regulator 40A includes an elongated crystalline body 42 of the quasi-1D crystalline FSDWS material and a load resistor 44. The elongated crystalline body 42 operates as a voltage controlled switch with ON and OFF states. The elongated crystalline body 42 has a cylindrically symmetric form, and the body's 1D anisotropy axis, A, is oriented along the body's axis of cylindrical symmetry. The load resistor 44 physically connects to one of end of the elongated crystalline rod 42 and has a resistance selected to satisfy loading and termination requirements desired for the voltage regulator 40A.

The voltage regulator 40A includes output terminals 50, 52 and input terminals 46, 48. The output terminals 50, 52 connect to opposite ends of the elongated crystalline body 42 so that the output load (not shown) connects in parallel with the elongated crystalline body 42. One input terminal 46 connects a first output terminal of an external voltage source 54, i.e., an AC or DC voltage source, to the load resistor 44. The other input terminal 48 connects a second output terminal of the external voltage source 54 to the end of the crystalline body 42 that is opposite the end to which the load resistor 44 connects. The input connections cause the input voltage, $V_{input}$, minus a voltage drop across the load resistor 44 to be applied across the elongated crystalline body 42.

The external voltage source 54 is configured to produce a peak output voltage that is sufficient to produce a strong electric field inside the elongated crystalline body 42. Application of the peak output voltage across the elongated crystalline body 42 causes free sliding of a charge density wave and/or spin density wave therein. Thus, in response to application of the peak voltage, the elongated crystalline body 42 operates on a vertical portion its current characteristic, e.g., portions 23 or 25 of the characteristic 22 shown in FIG. 3. Thus, application of a peak voltage by the external voltage source 54 causes the elongated crystalline body 42 to function as a closed low resistance switch, i.e., to be in the ON switching state. The large local slopes of vertical portions of current characteristics of quasi-1D FSDWS materials insure that output voltage, $V_{output}$, across output terminals 50, 52 depends, at most, weakly on the value of the peak voltage of the voltage source 54. The material properties and length of the elongated crystalline body 42 substantially fix the value of the output voltage, $V_{output}$, if $V_{input}$ is sufficiently large to produce a strong electric field inside the elongated crystalline body 42. For this reason, the device 40A functions as a voltage regulator that produces a preselected output voltage, $V_{output}$, in response to receiving a wide range of above threshold input voltages, $V_{input}$'s.

FIG. 5B shows the input-output voltage characteristic of voltage regulator 40A of FIG. 5A when an infinite load resistance (not shown in FIG. 5A) is connected across output terminals 50, 52. For input voltages, $V_{input}$, i.e., across terminals 46 and 46 of FIG. 5A, that are too small to produce strong fields inside elongated crystalline body 42, the output voltage, $V_{output}$, is approximately a linear function of $V_{input}$. For $V_{input}$'s large enough to produce strong electric fields in the elongated crystalline body 42, $V_{output}$ saturates at a value, $V_R$, that is substantially determined by the properties of the elongated crystalline body 42 alone.

Since conductivity properties of quasi-1D crystalline FSDWS materials are bulk properties, objects made from such materials also enable simply fabricating variable voltage regulators.

FIG. 5C shows a variable voltage regulator 40C that includes an elongated crystalline body 42 of quasi-1D FSDWS material, load resistor 44, and an N-position switch 60. The N-position switch selectively connects a single switch input 62 to one of a plurality of switch outputs $O_1$-$O_N$. The switch outputs $O_1$-$O_N$ connect to corresponding tap contacts $56_1$-$56_N$ that are distributed along the length of the elongated crystalline object 42.

At different switch positions, N-position switch 60 applies a voltage across portions of the elongated crystalline body 42 of different length. The current carrying portions of the crystalline body 42 support approximately the same internal electric field values if the $V_{input}$'s are sufficiently large to produce strong electric fields in those portions of the body 42. Since the internal electric field values are thus, independent of the switching position of the N-position switch 60, regulated output voltages, $V_R$, generated across output terminals 50, 52 are proportional to the length of the current carrying portion of the elongated crystalline body 42 for the corresponding switching positions. At switch position M, the regulated output voltage, $V_R$, from variable voltage regulator 40C is approximately proportional to the length of the portion of the elongated crystalline body 42 located between end contact point 64 and the position of the corresponding tap contact $56_M$.

Figure 5D:
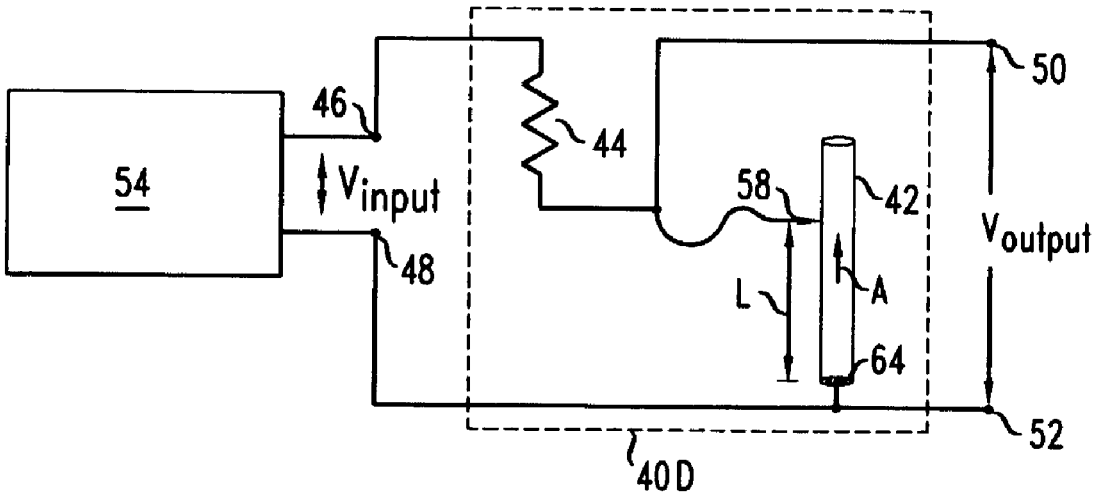
FIG. 5D shows an alternate variable voltage regulator that is based on a quasi-1D crystal that supports a free sliding density wave state.

FIG. 5D shows an alternate variable voltage regulator 40D. The variable voltage regulator 40D is similar to variable voltage regulator 40C of FIG. 5C except that the N-position switch 60 and multiple tap contacts $56_1$-$56_N$ are replaced by a single movable tap contact 58. The movable tap contact 58 is displaceable along the length of elongated crystalline body 42, e.g., manually displaceable along a slide-wire positioning unit (not shown). Displacing the movable tap contact 58 changes the length, L, of the portion of the elongated crystalline body 42 that is located between the moveable tap contact 58 and end contact point 64. Thus, displacing the moveable tap contact 58 changes the value of the regulated output voltage, e.g., $V_R$ of FIG. 5B, that is produced across output terminals 50 and 52.

From the disclosure, drawings, and claims, other embodiments of the invention will be apparent to those skilled in the art.

What is claimed is:

1. An apparatus, comprising:

a voltage regulator, comprising:

an object formed of a quasi-1D crystalline material, the material being capable of supporting a free sliding density wave state;

first and second input terminals connected to apply a voltage across a first portion of the object;

first and second output terminals connected across a second portion of the object; and a multiple position switch having a single input and M selectable outputs, the single input being connected to one of the input terminals and the M outputs being connected to M corresponding tap contacts distributed along the object; and wherein M is greater than 1.

2. The apparatus of claim 1, comprising:

a voltage source connected across the input terminals; and wherein the voltage source is capable of producing an electric field that switches the second portion of the object from an insulating state to a conducting state.

3. The apparatus of claim 2, wherein the voltage source is able to produce a first value of an electric field in the quasi-1D crystalline material, the first value corresponding to a point of a current-electric field characteristic of the quasi-1D crystalline material whose local slope is larger by a factor of at least ten than the local slope of the characteristic corresponding to a second value of the electric field, the first value having a magnitude that is between 2 and 10 times larger than a magnitude of the second value.

4. The apparatus of claim 3, wherein the first value corresponds to a local slope of the characteristic that is larger by a factor of at least thirty than the local slope of the characteristic corresponding to the second value.

5. The apparatus of claim 1, wherein the quasi-1D crystalline material has its 1 D anisotropy direction substantially oriented along a direction of current flow between the input terminals.

6. The apparatus of claim 1, wherein the quasi-1D crystalline material is a doped cuprate ladder compound.

7. The apparatus of claim 1, wherein the quasi-1D crystalline material includes one of $Sr_{14}Cu_{24}O_{41}$ and $Sr_{14-x}Ca_xCu_{24}O_{41}$.

8. The apparatus of claim 7, wherein the quasi-1D crystalline material has a "c" crystalline axis oriented approximately along a direction of current flow between the input terminals.

9. The apparatus of claim 1, wherein the crystalline material has a density wave state with a melting temperature that is higher than room temperature.

10. An apparatus, comprising:

a voltage regulator, comprising:

an object formed of a quasi-1D crystalline material, the material being capable of supporting a free sliding density wave state;

first and second input terminals connected to apply a voltage across a first portion of the object;

first and second output terminals connected across a second portion of the object; and a moveable contact capable of being displaced between first and second positions, the contact configured to apply a portion of an input voltage across different first portions of the object in response to being at the respective first and second positions.

11. The apparatus of claim 10, further comprising:

a voltage source connected across the input terminals; and wherein the voltage source is capable of producing an electric field that switches the second portion of the object from an insulating state to a conducting state.

12. The apparatus of claim 11, wherein the voltage source is able to produce a first value of an electric field in the quasi-1D crystalline material, the first value corresponding to a point of a current-electric field characteristic of the quasi-1D crystalline material whose local slope is larger by a factor of at least ten than the local slope of the characteristic corresponding to a second value of the electric field, the first value having a magnitude that is between 2 and 10 times larger than a magnitude of the second value.

13. The apparatus of claim 12, wherein the first value corresponds to a local slope of the characteristic that is larger by a factor of at least thirty than the local slope of the characteristic corresponding to the second value.

14. The apparatus of claim 10, wherein the quasi-1D crystalline material has its 1D anisotropy direction substantially oriented along a direction of current flow between the input terminals.

15. The apparatus of claim 14, wherein the quasi-1D crystalline material has a "c" crystalline axis oriented approximately along a direction of current flow between the input terminals.

16. The apparatus of claim 10, wherein the quasi-1D crystalline material is a doped cuprate ladder compound.

17. The apparatus of claim 10, wherein the quasi-1D crystalline material includes one of $Sr_{14}Cu_{24}O_{41}$ and $Sr_{14-x}Ca_xCu_{24}O_{41}$.

18. The apparatus of claim 1, wherein the crystalline material has a density wave state with a melting temperature that is higher than room temperature.

* * * * *